US006644831B2

(12) United States Patent
Simon

(10) Patent No.: US 6,644,831 B2
(45) Date of Patent: Nov. 11, 2003

(54) LAMP CHANGE SYSTEMS IN OPTICAL LUMINAIRES

(76) Inventor: Jerome H. Simon, 70 Summer St., Newton Centre, MA (US) 02459

( * ) Notice: Subject to any disclaimer, the term of this patent is extended or adjusted under 35 U.S.C. 154(b) by 0 days.

(21) Appl. No.: 10/132,638

(22) Filed: Apr. 24, 2002

(65) Prior Publication Data

US 2002/0181239 A1 Dec. 5, 2002

Related U.S. Application Data

(60) Provisional application No. 60/286,051, filed on Apr. 24, 2001.

(51) Int. Cl.[7] ..... F21V 33/00

(52) U.S. Cl. ..... 362/226; 362/157; 362/416; 362/431

(58) Field of Search ..... 362/226, 416, 362/457, 431

(56) References Cited

U.S. PATENT DOCUMENTS 5,526,243 A * 6/1996 Masters ..... 362/122
6,523,982 B1 * 2/2003 Haddad ..... 362/375
6,530,675 B1 * 3/2003 Van Etten ..... 362/267

* cited by examiner

*Primary Examiner*—Laura K. Tso
(74) *Attorney, Agent, or Firm*—Perkins, Smith, Cohen; Jerry Cohen; Harvey Kaye

(57) ABSTRACT

A mechanical device that allows for changing a lamp that, when in its operating position, is surrounded by an optical system that is close to the lamp and therefore restricts access for lamp removal and accurate replacement within the optical system. This mechanical device may be used in any lighting product with or without an optical system to facilitate lamp/bulb changes. This mechanical device can be integrated into the structure of various lighting products such as table and floor lamps, ceiling fixtures and pendants, and outdoor poles. A lighting product which has been integrated with this lamp change device has the means to radiate light for desired illumination: a lamp (bulb) surrounded by said light radiator, said bulb is connected to a socket which is further connected to a socket mounting means. The socket mounting means is manually moved up and down axially with a lamp support means such as a pole or lamp stem, and a lamp access means such as an opening within the support means for accessing and changing the lamp.

11 Claims, 4 Drawing Sheets

LAMP CHANGE SYSTEMS IN OPTICAL LUMINAIRES

REFERENCE TO RELATED APPLICATIONS

The present application is based on and claims the priority of provisional application Ser. No. 60/286,051 filed Apr. 24, 2001. The substance of that application is hereby incorporated herein by reference.

FIELD OF THE INVENTION

The present invention relates generally to the lighting field and, more particularly, to a device for changing the lamp (bulb) in lighting fixtures where access to the lamp (bulb) is limited.

BRIEF SUMMARY OF THE INVENTION

The present invention is a lamp (bulb) change system for luminaires where the bulb is surrounded by an optical system that does not allow access for it to be changed; and for luminaires where lamp change is inconvenient, as on poles that are high above the ground and the removal of a large portion of the luminaire is impractical; and also for a lamp change system that is integrated into the pole or stem of a luminaire where the pole or stem provides structure for access to and the alignment of the lamp change system.

Other objects, features and advantages will be apparent from the following detailed description of preferred embodiments taken in conjunction with the accompanying drawings in which:

DETAILED DESCRIPTION OF THE DRAWINGS

Figure 1:
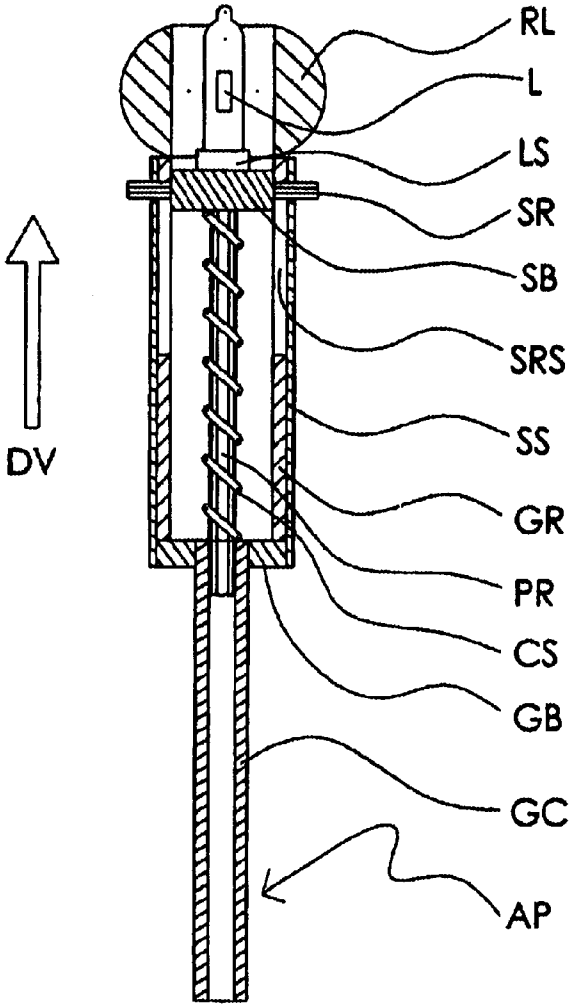

FIG. 1 shows a bulb L within its operating position surrounded by ring lens RL. Bulb L is mounted in a lamp socket LS, which is secured to a base SB, which is in turn secured to plunger rod PR. Plunger rod PR is designed to slide up and down within guide cylinder GC. Therefore, as plunger rod PR slides down within guide cylinder GC, lamp L is made to slide down from the confined space of ring lens RL. This is illustrated in FIG. 2 by lamp L following the downward movement of arrow DD.

The lamp change device AP includes guide cylinder GC is attached to guide base GB which is part of a structure including guide bars GR, which remains at a constant distance from RL. The structure including GB, GC and GR form a guide over which tubular sleeve SS is arranged to slide. Since SS is attached directly to base SB via pins SR, when SS is in the up position (FIG. 1 arrows DU) lamp L is in its operating position. When SS is pulled down manually (FIG. 2, arrows DD), the lamp L is exposed between guide bars GR within open space OA, through which lamp L can be removed and replaced. When SS is pulled down, compression spring CS is compressed between SB and GB so that, when SS is released, pins SR travel in slots SRS within guide bars GC and lamp L returns to its operating (closed off) position. These slots SRS limit the travel of pins SR and provide accuracy to the positioning of lamp L.

Figure 2:
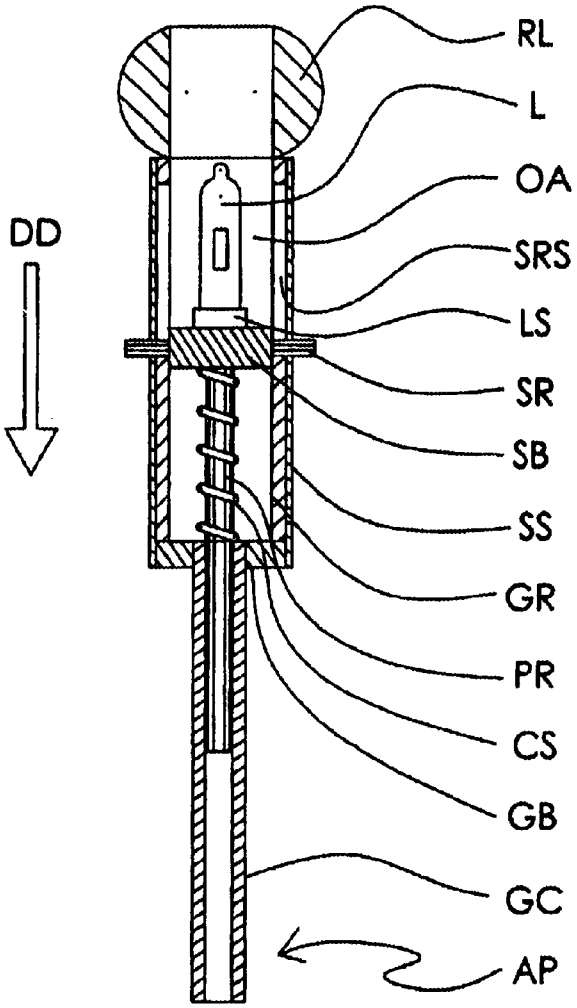
FIG. 1 and FIG. 2 are cross-sectional views of the same lighting device, illustrating a method for changing a lamp (bulb) that is surrounded by an optical system that, due to its proximity to the lamp, does not allow room for removal or replacement of the lamp.
Figure 3:
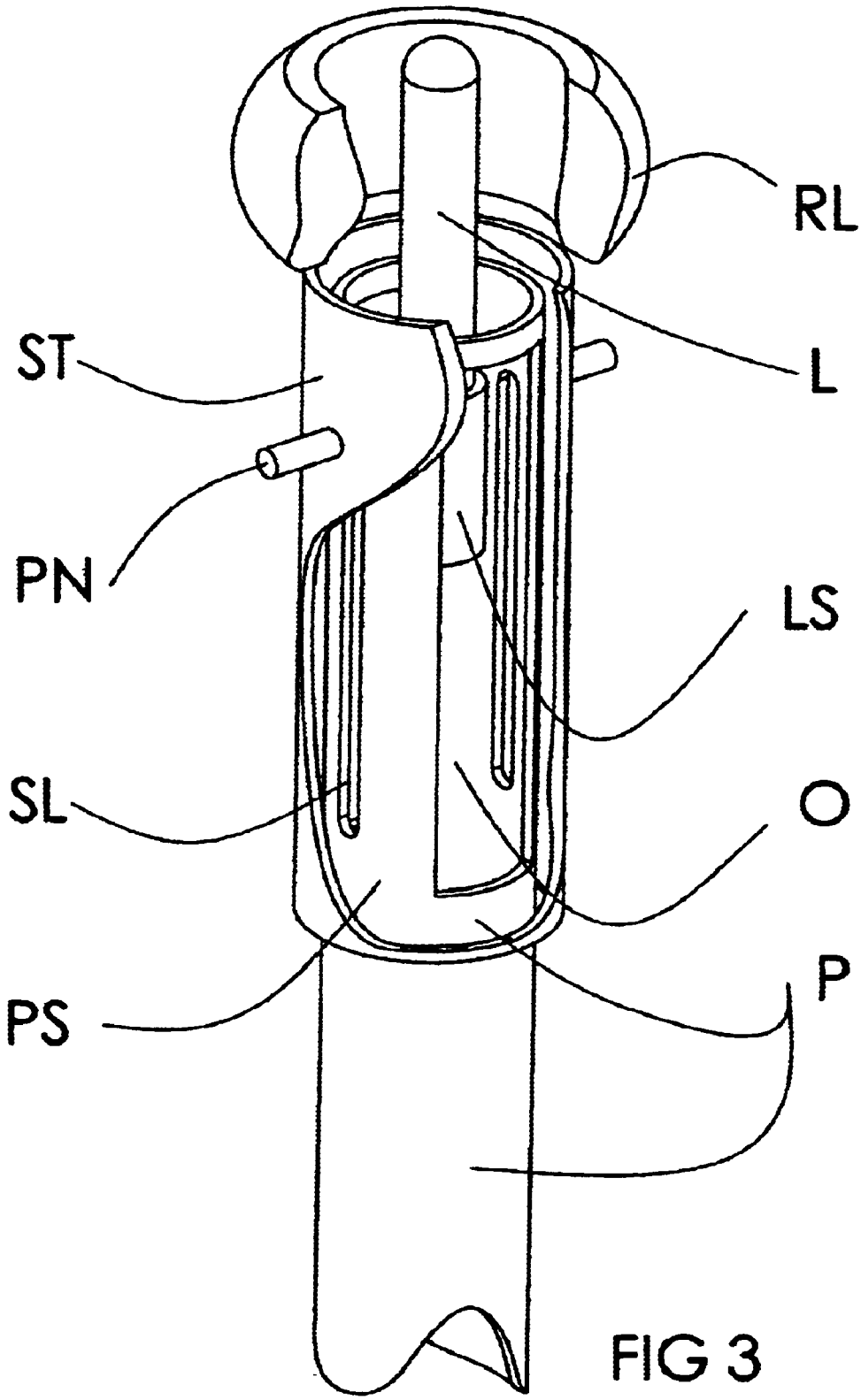
FIG. 3 is an isometric view of the device shown in FIGS. 1 and 2.

FIG. 3 is an isometric view of a device similar in structure to that in FIGS. 1 and 2, illustrating how the described lamp change system can be integrated into the post of a pole lamp or a torchiere. The slider tube ST, which is attached to lamp socket LS by pin PN, slides up and down over pole P, bringing lamp L into reach through opening O in pole P. Pin PN rides in slot SL in pole section PS.

Figure 4:
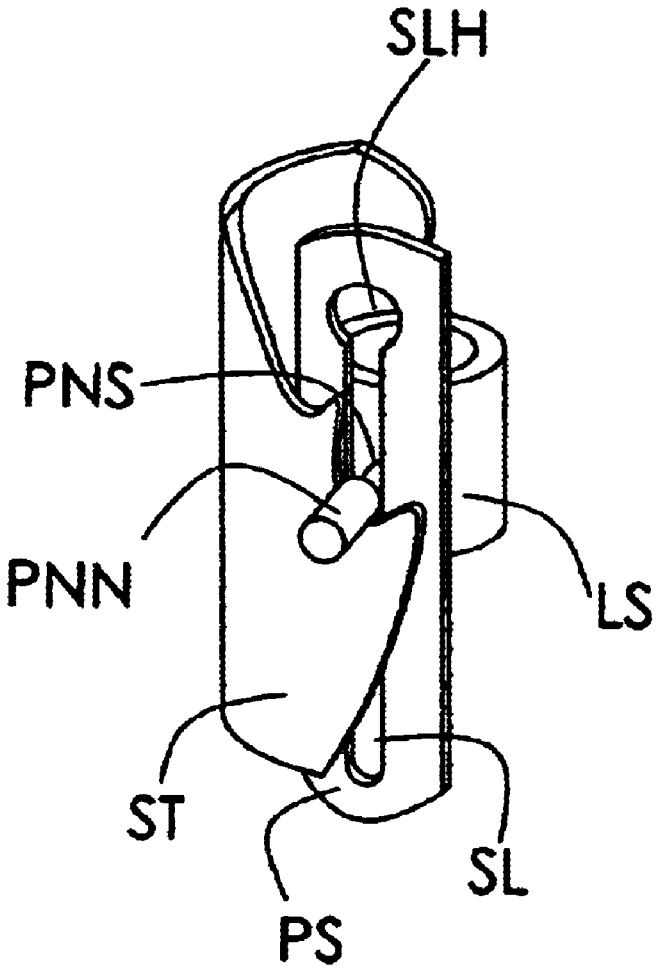
FIG. 4 is an isometric view of a detail of the structure shown in FIG. 3.

FIG. 4 is a cutaway detail of FIG. 3 illustrating a means for securing socket LS into a desired vertical location and for keeping opening O enclosed by slider tube ST. Pin PN is comprised of screw stud PNS and nut PNN, which can be tightened through hole SLH in slot SL, locking socket LS in the designated position.

The devices in FIGS. 1, 2, and 3 all have sockets (LS) that remain axially centered within the device whether in either the operating or the lamp change position or any position in between.

Figure 6:
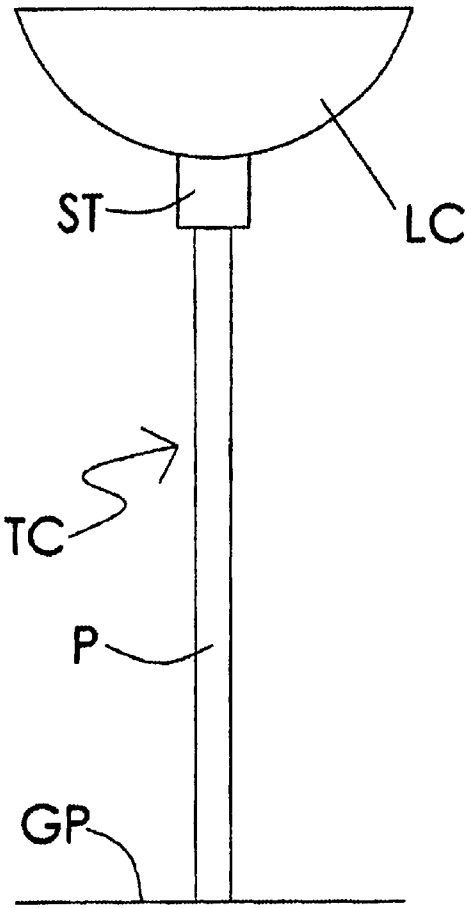
FIG. 6 is a side schematic view of a pole lamp fixture containing a lamp (bulb).
Figure 5:
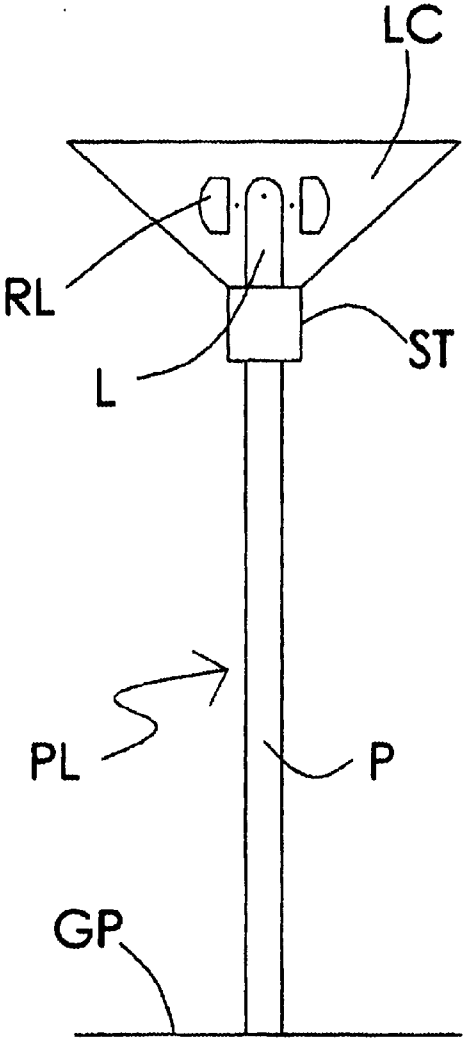
FIG. 5 is a side schematic view of a pole lamp fixture containing a lamp (bulb) surrounded by a lens.

FIGS. 5 and 6 illustrate a pole lamp PL and a torchiere lamp TC respectively. In FIG. 5, pole lamp PL is mounted on ground plane GP has a slider ST which slides over pole P. Ring lens RL and lamp L are seen through transparent pole top luminaire LC. In FIG. 6, torchiere lamp TC mounted on ground plane GP shows a slider ST that slides over pole P and lampshade LC.

The present invention includes many mechanical means of lamp changes where the lamp is moved along the axis of the luminaire support and is removed from an opening in the support.

The present invention provides a mechanical device that allows for changing a lamp that, when in its operating position, is surrounded by an optical system that is close to the lamp and therefore restricts access for lamp removal and accurate replacement within the optical system. This mechanical device may be used in any lighting product with or without an optical system to facilitate lamp/bulb changes. This mechanical device can be integrated into the structure of various lighting products such as table and floor lamps, ceiling fixtures and pendants, and outdoor poles. A lighting product which has been integrated with this lamp change device has the means to radiate light for desired illumination: a lamp (bulb) surrounded by said light radiator, said bulb is connected to a socket which is further connected to a socket mounting means. The socket mounting means is manually moved up and down axially with a lamp support means such as a pole or lamp stem, and a lamp access means such as an opening within the support means for accessing and changing the lamp.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A lamp changing device for use in a lighting system, comprising:

a. a lamp fixture support;

b. a lamp socket arranged to removably hold a lamp;

c. a mounting assembly movably mounting said lamp socket to said support, said mounting assembly permitting axial movement along said fixture support; and d. access means forming a part of the support and permitting access to the lamp socket for selectively inserting and removing a lamp.

2. A device as defined in claim 1 wherein the access means is an opening in the support.

3. A device as defined in claim 1 wherein the access means is at least one hole within said support to provide access to the lamp for ease of lamp replacement.

4. A device as defined in claim 1, wherein said mounting assembly moves axially along the fixture support.

5. A device as defined in claim 1 wherein said mounting assembly is spring mounted so that the bulb is returned to its operating position after it has been replaced.

6. A device as defined in claim 1 wherein said mounting assembly is held in place by spring buttons and depressing said buttons release said mounting assembly to move axially along said lamp support for lamp access.

7. A device as defined in claim 1 wherein said mounting assembly is held in place by down screws and loosening said screws allows the mounting assembly to move axially along said lamp support means for lamp (bulb) access.

8. A device as defined in claim 1 wherein said mounting assembly is connected to a sleeve surrounding said support and which covers said access means when the lamp is in the operating position.

9. A device as defined in claim 1 wherein said support is a lamp stem.

10. A device as defined in claim 1 wherein said support is a light pole.

11. A lamp changing device for use in a lighting system which includes a lamp fixture support, a lamp surrounded by an optical system which includes a lens and/or a reflector and a socket for holding the lamp, the improvement comprising:

a. a mounting assembly movably mounting the lamp socket to the support, said mounting assembly allowing axial movement along the fixture support; and b. access means forming a part of the support and allowing access to the lamp socket for selectively inserting and removing the lamp.

* * * * *